United States Patent [19]

De Pagter

[11] Patent Number: 5,060,799

[45] Date of Patent: Oct. 29, 1991

[54] PACKAGING FOR FLOWERS

[75] Inventor: Janus A. W. De Pagter, Dinteloord, Netherlands

[73] Assignee: Pagter & Partners International B.V., Dinteloord, Netherlands

[21] Appl. No.: 254,706

[22] Filed: Oct. 7, 1988

[30] Foreign Application Priority Data

Oct. 9, 1987 [NL] Netherlands ..... 8702405

[51] Int. Cl.[5] ..... B65D 85/50; B65D 85/52

[52] U.S. Cl. ..... 206/423; 220/4.03; 220/913

[58] Field of Search ..... 206/423; 220/8, 4.03, 220/913

[56] References Cited

U.S. PATENT DOCUMENTS

| | | | |
|---|---|---|---|
| 118,768 | 9/1871 | Wilson | 220/8 |
| 211,984 | 2/1879 | Gage | 217/124 |
| 236,812 | 1/1881 | Higgins | 217/124 |
| 682,495 | 9/1901 | Richards | 220/8 |
| 1,090,565 | 3/1914 | Port | 217/56 |
| 1,116,752 | 11/1914 | Stolk | 220/8 |
| 1,612,166 | 12/1926 | Baldwin | 217/124 |
| 1,827,396 | 10/1931 | Luckett | 220/8 |
| 2,876,924 | 3/1959 | Chrisman | 220/8 |
| 3,127,011 | 3/1964 | Weddle . | |
| 3,240,374 | 3/1966 | Langey | 217/56 |
| 3,395,787 | 8/1968 | Plaskan | 220/8 |
| 3,504,843 | 4/1970 | McCrea | 217/56 |
| 3,521,810 | 7/1970 | Boyer | 220/8 |
| 3,685,719 | 8/1972 | Goldman | 217/56 |
| 3,973,356 | 8/1976 | Schacht | 220/8 |
| 4,784,112 | 11/1988 | Hayashi | 220/8 |

FOREIGN PATENT DOCUMENTS

| | | |
|---|---|---|
| 0164795 | 12/1985 | European Pat. Off. . |
| 7701234 | 7/1978 | Netherlands . |

*Primary Examiner*—Joseph Man-Fu Moy

*Attorney, Agent, or Firm*—Fleit, Jacobson, Cohn, Price, Holman & Stern

[57] ABSTRACT

Packaging for flowers comprising a crate (1) and an extension (2) to be placed on this crate with a cover part of the extension (3) at the top. The cover part (3) is removable or hingeable. This packaging is suitable for dry and wet packing of upright flowers. In the case of wet packing, the packaging cannot leak. By the fast removal or hinging of the cover part, the packed flowers can be displayed from the top and the cover part can be replaced in the closed position without any problem. By removing the extension, the tightly packed flowers will fan out, so that transfer to a bucket is not necessary.

8 Claims, 2 Drawing Sheets

PACKAGING FOR FLOWERS

BACKGROUND OF THE INVENTION

The invention relates to packaging for flowers.

Flowers can be transported both wet and dry over Large distances provided they are packed in a suitable packaging. The disadvantages of wet packing is that growth can continue if the cooling is not well controlled. A disadvantage of dry packing is that drying out can take place and that the flowers must be unpacked rapidly and placed in water on arrival. A known wet packaging is a bucket or watertight box in an outer box. The flowers can be displayed by removing the entire outer box. In the case of a watertight inner box, there are two possibilities: one in which cardboard is coated with wax, and one in which cardboard is coated with plastic. The first possibility leads to leakage at the folds and the second possibility is expensive. All known packagings have the drawback that the flowers have to be transferred on arrival in the shop or flower hall.

The aim of the invention is to provide a relatively inexpensive packaging for upright packing of flowers, which is suitable for dry and wet packing and which, in the case of wet packing, cannot leak; furthermore, it is an objective of the invention to design this packaging so that the packed flowers can be displayed from the top by the simple removal or hinging of a part of the packaging and that the part can be replaced in the closed position without any problem. Finally, the packaging according to the invention is intended to enable, by removal of a part thereof, the flowers to be displayed to the public in a shop or flower stall without their having to be transferred to a bucket or the like.

SUMMARY OF THE INVENTION

According to the invention, the packaging is characterized for this purpose by a crate and a box to be placed on this crate with the base at the top, the box or extension cover part being removable or hingeable.

The crate, which usually is made of plastic and optionally has openings in the walls, has, just below its upper edge, a ridge or edge on which the bottom edge of the upside down box of cardboard (the extension) with wax rests. It is not entirely precluded that the box is provided with an edge or ridge on which the upper edge of the crate grips.

It is possible to seal the crate and box with one another solely with adhesive tape. However, it is better to also employ separate locking devices for the detachable locking of box and crate, for example, by using projecting lips and openings intended to receive these.

To make the packaging easy to handle, the box is provided with hand-grip openings.

The crate preferably nestable in an equivalent crate.

The box base or cover part should be connected to the box in a hingeable manner. However, it is better to make the box base wholly removable and to provide it with folded over projecting edges which can be fixed on the box by adhesive tape.

BRIEF DESCRIPTION OF THE DRAWINGS

The invention will now be illustrated in more detail with the aid of the figures, in which an example of an embodiment is shown.

DESCRIPTION OF PREFERRED EMBODIMENT

The packaging shown comprises a plastic crate 1 and a cardboard box or extension 2, of which the base or cover part 3 is loose.

Figure 1:
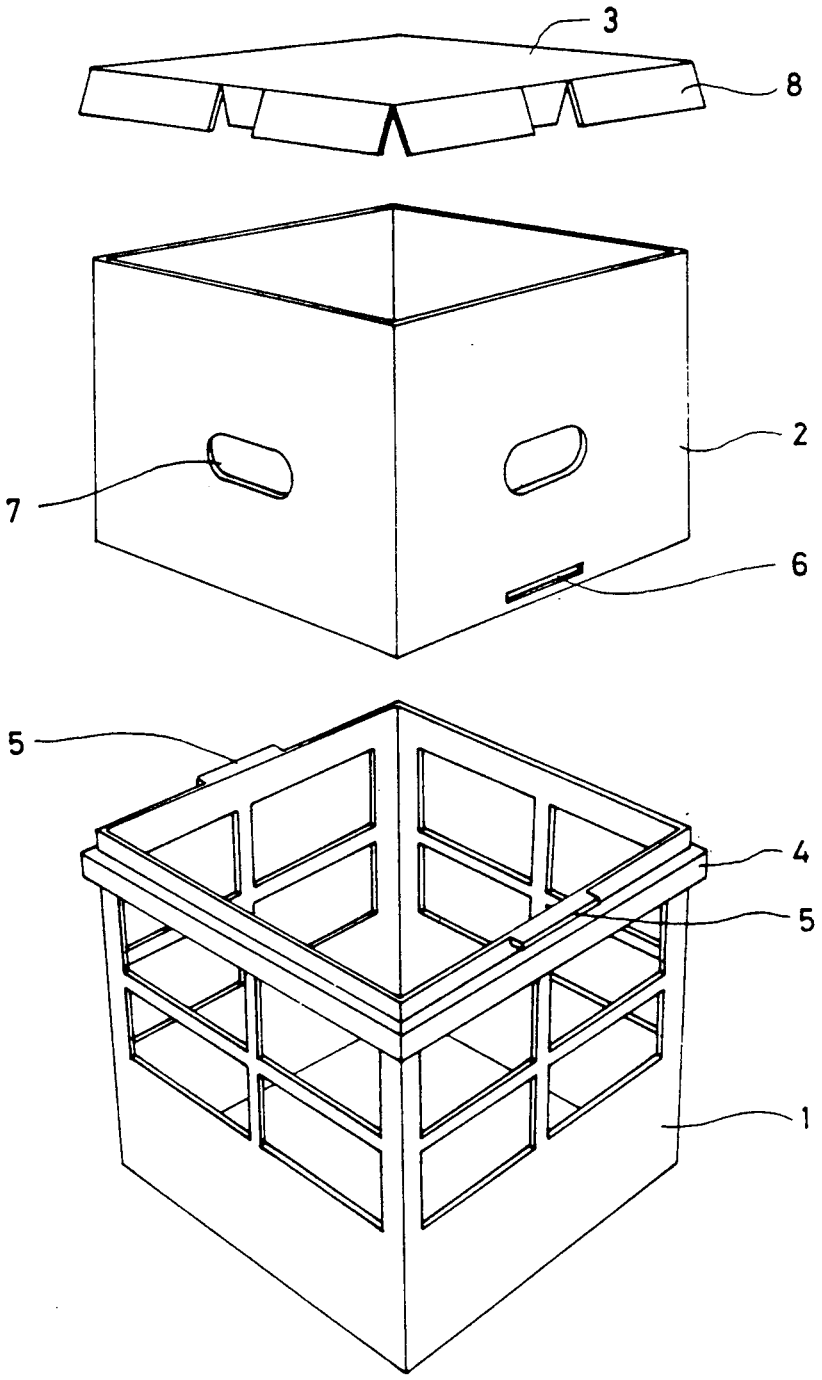
FIG. 1 shows a perspective view of a packaging in the dismantled state.
Figure 2:
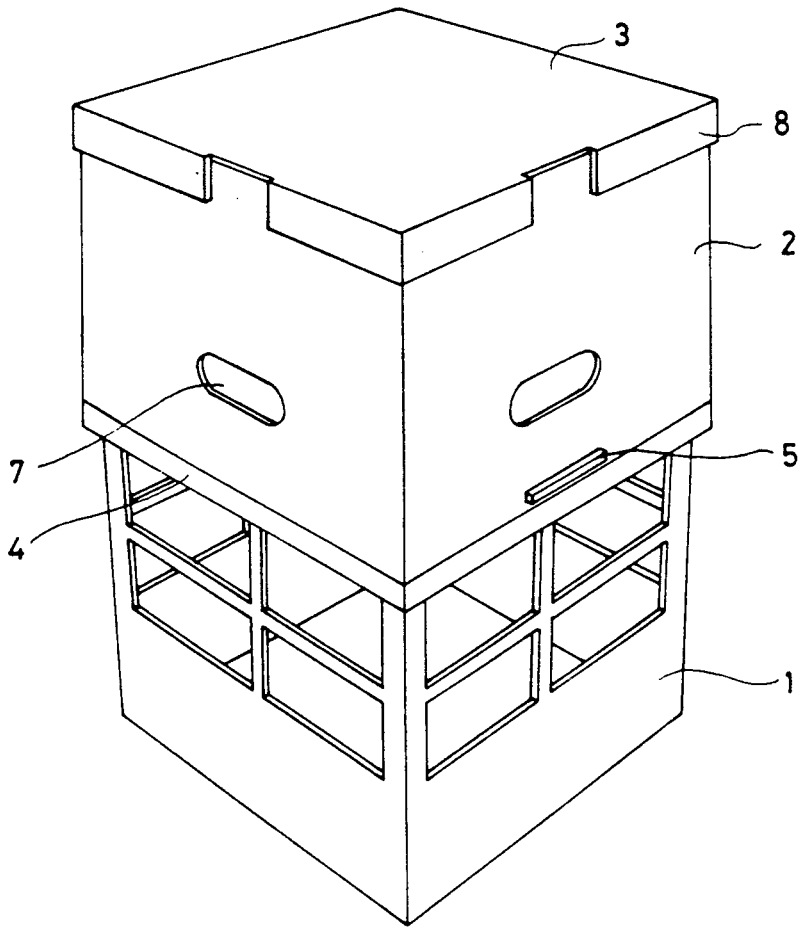
FIG. 2 shows a perspective view of this packaging in the assembled state.

The crate has a rectangular cross-section and the cross-section surface area decreases slightly from top to bottom, so that nesting of crates is possible. An upwardly projecting ridge 4, on which, as FIG. 2 shows, the bottom edge of the box 2 can rest, is provided just below the top edge.

The extension 2, which, for example, can be made water-tight with wax, has a rectangular cross-section such that it can be pushed over the top edge of the crate until the lower edge of the extension rests on the ridge 4.

The crate is also provided with two outwardly projecting lips 5, which can grip in openings 6 of the extension to enable extension and crate to be detachably locked to one another. In practice, the fixing of crate and extension is reinforced by adhesive tape. The extension also has a hand-grip opening 7 in each of its side faces.

The loose cover part 3, which in fact forms the top of the packaging, is also made of cardboard and has projecting folded edges 8 which can be fixed to the extension with adhesive tape.

The packaging is filled with flowers while the extension 2 is in position on the crate 1 without cover part 3. After filling, the cover part 3 is firmly fixed on the extension 2. The cover part 3 can temporarily be removed at the auction or the like to display the flowers from the top.

In the shop or flower hall the extension 2 is removed and the tightly packed flowers fan out. Transfer to a bucket is not necessary.

In connection with saving of material and good cooling, the side walls of the crate 1 are provided with openings 9. A completely solid-walled crate is, however, entirely possible.

The extension 2 can be of various heights, depending on the length of the flowers to be packed.

The cover part 3 can be of various materials and shapes, depending on the manner of closure. A profile, which prevents a crate shifting on the cover part, can also be provided in or on the cover part.

Within the scope of the invention, various modifications of the packaging shown and described are possible.

I claim:

1. Packaging for flowers comprising a plastic crate having inclined walls so that it is nestable in an equivalent crate, said crate being provided at its upper part with a circumferential ridge;

an extension having cardboard side walls and a cover part which can open and close, wherein the extension is receivable on top of the crate with the cover part uppermost and the side walls of the extension are supported resting on top of the circumferential ridge.

2. Packaging according to claim 1, including means for detachably locking the extension to the crate.

3. Packaging according to claim 2, wherein the locking means comprises mutually engageable lips and openings on the crate and extension, respectively.

4. Packaging according to claim 1, wherein the extension is provided with hand grip openings.

5. Packaging according to claim 1, wherein the cover part of the extension is removable from the extension.

6. Packaging according to claim 5, wherein the cover part has projecting edges.

7. Packaging according to claim 1, wherein the cover part is hinged to the extension.

8. Packaging according to claim 1, wherein the cover part, when located on the extension, has an upper face which is provided with a shift counteracting profile thereon.

* * * * *